US007289133B1

(12) United States Patent
Friedrich et al.

(10) Patent No.: US 7,289,133 B1
(45) Date of Patent: Oct. 30, 2007

(54) METHOD AND APPARATUS FOR TONER IDENTIFICATION

(75) Inventors: Kenneth P. Friedrich, Honeoye, NY (US); James D. Anthony, Victor, NY (US); Guy J. Rossi, Hilton, NY (US)

(73) Assignee: Eastman Kodak Company, Rochester, NY (US)

( * ) Notice: Subject to any disclaimer, the term of this patent is extended or adjusted under 35 U.S.C. 154(b) by 717 days.

(21) Appl. No.: 10/672,829

(22) Filed: Sep. 26, 2003

Related U.S. Application Data

(60) Provisional application No. 60/414,811, filed on Sep. 30, 2002.

(51) Int. Cl.
*G03G 21/00* (2006.01)
*B41J 25/00* (2006.01)

(52) U.S. Cl. ..... 347/112; 399/46

(58) Field of Classification Search ..... 399/46; 347/112

See application file for complete search history.

(56) References Cited

U.S. PATENT DOCUMENTS 6,236,816 B1 5/2001 Warbus et al. ..... 399/46

6,965,744 B1 * 11/2005 Housel ..... 399/82

* cited by examiner

*Primary Examiner*—Huan Tran
(74) *Attorney, Agent, or Firm*—Richard A. Romanchik; Robert L. Walker

(57) ABSTRACT

A simple and economical method and apparatus for identifying the toner installed in a multi-toner printer by identifying the toner holder installed in the printer is disclosed. Additionally, the multi-toner printer is controlled based on the toner holder installed and a job selection. A toner identification apparatus comprising a toner identification module, a display device, and an input device, identifies the toner holder installed in a multi-toner printer by producing and identifying a unique voltage identification signal for the installed toner holder. A job selection algorithm determines whether the installed toner holder is the correct toner holder for a specified job selection. Additionally, if the toner holder installed in the multi-toner printer contains MICR toner, the job selection algorithm mandates a security procedure that must be carried out in order for printing to be allowed. In response to the job selection algorithm, the toner identification apparatus creates a control signal that instructs a control device of a multi-toner printer whether to allow a selected print job.

9 Claims, 4 Drawing Sheets

METHOD AND APPARATUS FOR TONER IDENTIFICATION

RELATED APPLICATIONS

This application claims priority to U.S. Provisional Patent Application Ser. No. 60/414,811 titled METHOD AND APPARATUS FOR TONER IDENTIFICATION which was filed on Sep. 30, 2002 and which is incorporated herein by reference in its entirety.

FIELD OF THE INVENTION

The present invention relates to electrographic print engines, and more particularly to multi-toner electrographic print engines which identify the toner that is installed.

BACKGROUND

Today, many printers, both commercial and non-commercial, are capable of printing many types of print jobs. A print job includes both the documents that are to be printed and the printing instructions associated with those documents. The printing instructions (the "job selection") may specify almost any attribute the printed document is to have including but not limited to, the number of copies, and the type of ink (toner), paper, and font to be used, and may be specified by a customer, or other individual or mandated by the type of print job. Because different types of toner may be required or desired for different print jobs, some printers are capable of printing with a variety of toner types. These "multi-toner" printers enable printing for almost every conceivable purpose, application and industry and are limited only by the types of toner available. The almost limitless range of colors available enable printing for virtually any type of commercial, personal, or artistic endeavor. Additionally, toner is available in magnetically-readable form which allows magnetically-readable characters to be printed. Types of toner include, but are not limited to, toners of various colors, and toner in magnetically-readable and non-magnetically readable form, which may also come in various colors.

In order to accommodate the use of many different types of toner, various methods and mechanisms have been devised. For instance, many multi-toner printers available for personal use, such as personal laser printers, are adapted to use exchangeable toner cartridges that may each contain a different type of toner. In another example, some commercial multi-toner printers are adapted to use exchangeable toner stations, wherein each toner station contains a different type of toner. In some cases, each toner station may be dedicated to a single toner or type of toner. Hereinafter, the term "toner holder" will be used to designate any exchangeable container for holding toner, including toner stations and toner cartridges.

One desirable feature for multi-toner printers to have is the ability to determine the type of toner currently installed in the printer. This feature is particularly desirable for commercial printers that print with both magnetically-readable and non-magnetically-readable toner. Magnetically-readable toner is used to create documents that will be read using some type of magnetic ink character recognition ("MICR") method, often without the aid of human intervention. These MICR documents may be, for example, financial documents such as checks. Because these MICR documents will be read magnetically, it is crucial that magnetically-readable toner ("MICR toner") be used when the MICR documents are printed. Additionally, because MICR toner is significantly more expensive than non-magnetically-readable ("standard toner"), it is also important that documents that do not have to be magnetically read ("standard documents") are not printed with MICR toner.

One method for determining the type of toner installed in a multi-toner printer is, of course, visual inspection of the toner holder by a person. However, people often forget to make such an inspection, particularly in rushed or otherwise stressed situations. In the case of a large print job, many pages may be printed and wasted before the incorrect toner is identified, if ever. Another known method for use with multi-toner printers that use exchangeable toner stations includes visual inspection by a laser scanner. U.S. Pat. No. 6,236,816 discloses a method that uses unique barcodes placed on toner stations wherein each of the barcode identifies the type of toner inside the toner station on which it is located. When a toner station is coupled to a printer, a laser scanner located in the printer optically reads the barcode to obtain a barcode reading. A processor then matches the barcode reading with entries in a table in order to identify the coupled toner station. Unfortunately, this method requires the use of an expensive laser scanner.

SUMMARY

A simple and economical method and apparatus for identifying the toner installed in a multi-toner printer by identifying the installed toner holder is disclosed. Preferably, when MICR toner or an MICR toner station is identified, a security procedure is mandated which, if not carried out, printing is disallowed. A toner identification apparatus comprising a toner identification module, a display device, and an input device, identifies the toner holder installed in a multi-toner printer by producing and identifying a unique voltage identification signal for the installed toner holder. A job selection algorithm determines whether the installed toner holder is the correct toner holder for a job selection specified by an operator of the multi-toner printer. Additionally, if the toner holder installed in the multi-toner printer contains MICR toner, the job selection algorithm mandates a security procedure that must be carried out in order for printing to be allowed. In response to the job selection algorithm, the toner identification apparatus creates a control signal that instructs a control device of a multi-toner printer whether to allow a selected print job.

BRIEF DESCRIPTION OF THE FIGURES

The invention may be better understood with reference to the following figures and detailed description. The components in the figures are not necessarily to scale, emphasis being placed upon illustrating the principles of the invention. Moreover, like reference numerals in the figures designate corresponding parts throughout the different views.

DETAILED DESCRIPTION

Disclosed herein is an economical method and apparatus for identifying the toner installed in a multi-toner printer by identifying the installed toner holder. Additionally, in a preferred embodiment, when MICR toner or an MICR toner station is identified, a security procedure is mandated which if not carried out, printing is disallowed.

Figure 1:
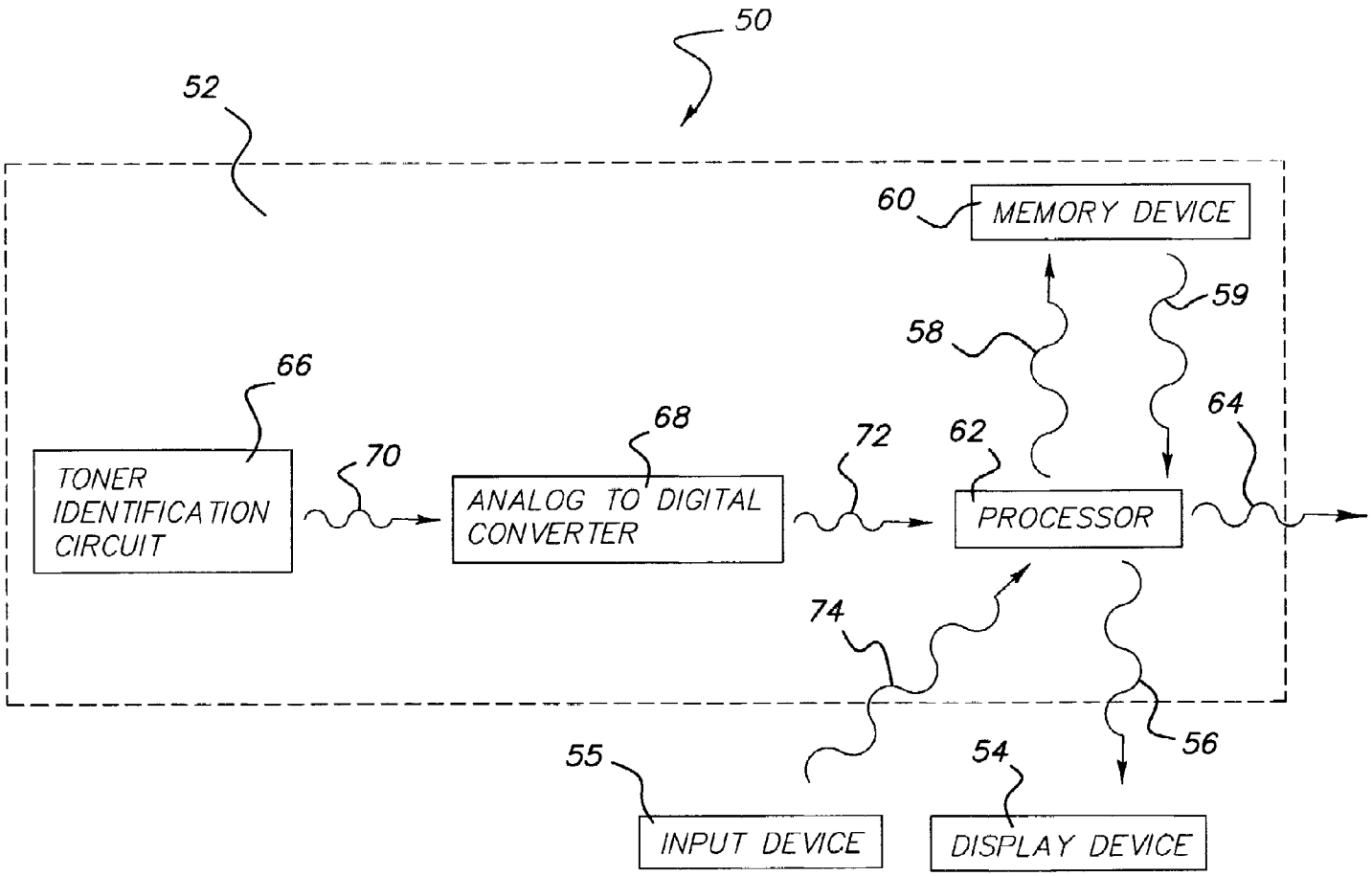
FIG. 1 is a block diagram of an embodiment of a toner identification apparatus for a multi-toner printer.

A toner identification apparatus is shown in FIG. 1 and indicated by reference numeral 50. The toner identification apparatus 50 generally comprises a toner identification module 52, a display device 54, and an input device 55. All the components of the toner identification module 52 are at least electronically coupled together and to the multi-toner printer so that the signals 56, 58, 59, 70, 72, 74 may be communicated among the components as indicated and so that signal 64 may be communicated to a control device (not shown) in the multi-toner printer, respectively. The control device is the hardware and (if needed) the software that enables the printer to print. In printers that use exchangeable toner stations, the control device includes the print engine. In printers for personal use, the control device is the printer itself. The display device 54 may be any type of visual, manual or audio device capable of communicating information from a processor or memory to a person. Display devices include the following examples, monitors, speakers and liquid crystal displays. The input device 55 is any type of visual, manual, electronic or audio device capable of communicating information from a person to a processor or memory. Input devices include the following examples, keyboards, touch screens, microphones, voice recognition systems, trackballs and mice. Alternatively, the input and display devices 55 and 56, respectively, may be included in a single device such as a computer with a monitor and mouse or trackball coupled to the processor 62 via a network and communicating with the processor 62 via the signals 56 and 74.

The toner identification module 52 produces a control signal 64 which, when coupled to a control unit of a multi-toner printer is used to control the operation of a multi-toner printer. The toner identification module 52 generally includes a toner identification circuit 66, an analog to digital converter 68, a processor 62 and a memory device 60. The processor 62 is any device capable of processing digital information. The memory device 60 may be any type of fixed or removable digital storage device and (if needed) a device for reading the digital storage device including, but not limited to, floppy disks and floppy drives, CD-ROM disks and drives, optical disks and drives, hard-drives, RAM, ROM and other such devices for storing digital information. Toner identification circuits 66 (only one shown) are generally located on each of a plurality of toner holders (not shown) and each toner identification circuit 66 produces an output voltage unique to the toner holder on which it is located (a "unique voltage identification signal 70"). Therefore, each toner holder can be assigned a unique voltage identification signal 70 that uniquely identifies the type of toner inside the toner holder on which it is located. The unique voltage identification signal 70 is received by the analog to digital converter 68. The analog to digital converter 68 converts the unique voltage identification signal 70 to a corresponding digital identification signal 72 that can be read by the processor 62. The digital identification signal 72 is received by the processor 62 which is coupled to a memory device 60. The memory device 60 stores a table of digital identification signals and the identification of the toner stations or toner cartridges to which each digital identification signal corresponds. This information is communicated to the processor 62 via memory signal 59. Using the memory signal 59, the digital identification signal 72, and an identification algorithm (not shown) the processor 62, determines the identity of the toner holder (the "toner holder identity") and communicates the toner holder identity to the display device 54 via a processor signal 56. Responses to the processor signal 56 displayed on display device 54 and other communications with the processor may be communicated to the processor 62 using the input device 55 via an input device signal 74. Additionally, if the processor 62 is coupled to a control device (not shown) in the multi-toner printer, the processor 62 may output a control signal 64 that includes instructions effecting the operation of the multi-toner printer. Alternatively, if a computer is used with the printer (dedicated or general purpose), the processor and memory of the computer may be used as processor 62 and a memory device 60, respectively.

The identification algorithm generally includes a table look-up algorithm. In response to receiving a digital identification signal 72, the processor looks up the digital identification signal in the memory device 60 and retrieves any corresponding toner station identities. Embodiments of the identification algorithm include computer readable software code. Such code may be stored on either the processor 62, the memory device 60 or on a computer readable storage medium or encoded in a computer readable electromagnetic signal. The code may be object code or any other code describing or controlling the functionality described herein. The computer readable storage medium may be a magnetic storage disk such as a floppy disk, an optical disk such as a CD-ROM, semiconductor memory or any other physical object storing program code or associated data.

Figure 2:
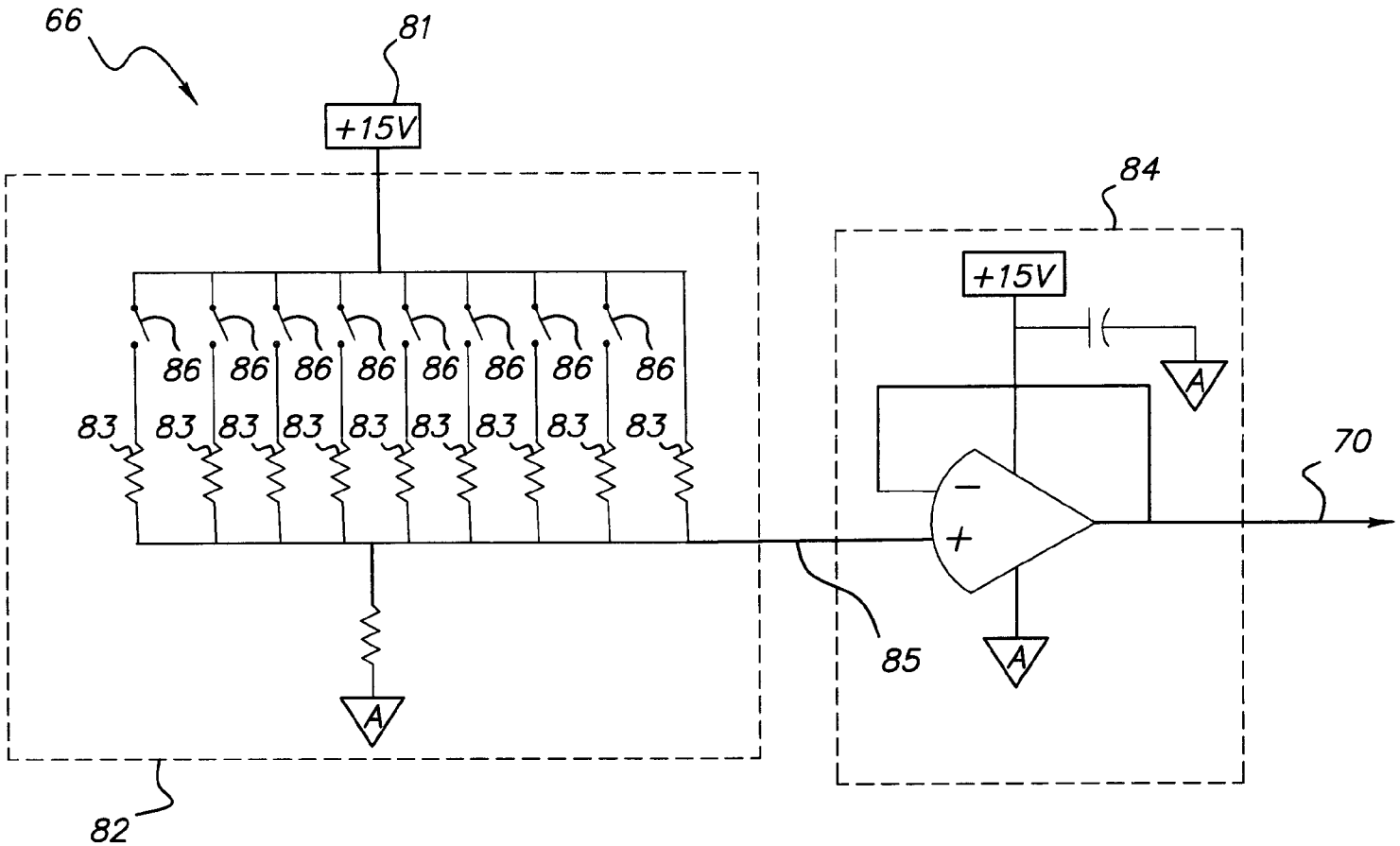
FIG. 2 is a circuit diagram of an embodiment of a toner identification circuit.

The toner identification circuit 66 is shown in more detail in FIG. 2. It generally includes a voltage divider 82 and an amplifier 84 which together produce the unique voltage identification signal 70. The voltage divider 82 includes a power source 81 and a plurality of series-connected switch 86 and resistor 83 pairs. Each series-connected switch and resistor pair is connected in parallel with each other and the power source 81. The switches may be any type of two-way switch such as a DIP switch. The voltage from the power source 81 is stepped-down depending on the number of switches 86 in the closed position. Therefore, one of several possible unique voltages 85 can be defined. In the embodiment shown in FIG. 2, one of eight (8) unique voltages 85 can be defined, however, more or fewer unique voltages can be defined by increasing or decreasing, relatively, the number of pairs of series-connected switches and resistors in the voltage divider 82. To uniquely identify a particular toner holder and therefore the type of toner inside the toner holder, a unique voltage 85 is defined by closing the proper number of switches in the voltage divider 82. This unique voltage 85 is buffered by the amplifier 84 to create a unique voltage identification signal 70.

Figure 3:
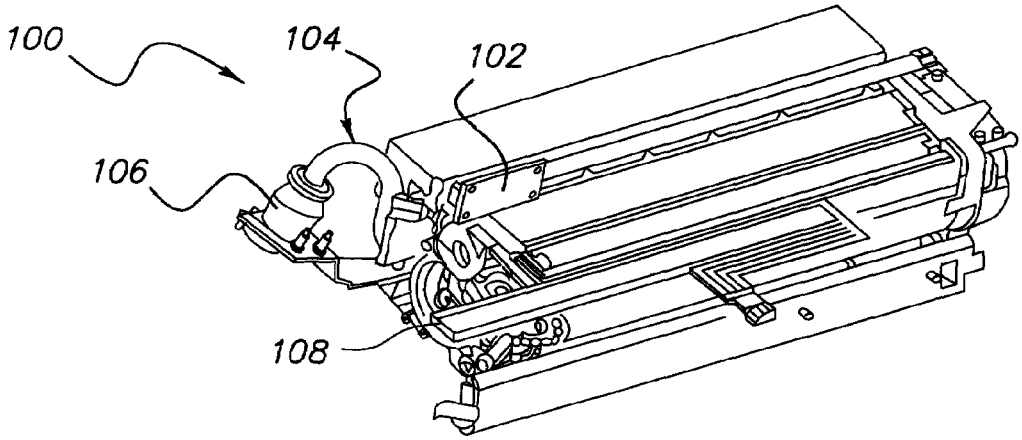
FIG. 3 is an isometric view of an embodiment of a toner identification circuit installed in a toning assembly.

In an one embodiment, the toner identification circuit 66 is physically mounted somewhere on a toner station of a printer using exchangeable toner stations. The toner identification circuit 66 provides identification of the toner station on which it is located. Although this example shows an embodiment for a printer with exchangeable toner stations, a similar configuration can be used to implement the methods and apparatuses for a printer that uses exchangeable toner cartridges. FIG. 3 shows one way in which this mounting may be accomplished. In the embodiment shown in FIG. 3, the toner identification circuit 66 is mounted on a circuit board 102 which is mounted on the toner assembly 100 of a toner station (only the toner assembly is shown). Although the location of the circuit board 102 is not critical, it should be located so as not to interfere with the operation of the toner station and so that the circuit board 102 has ready access to an electrical coupling. The circuit board 102 may be dedicated to the toner identification circuit 66 (not shown) or may include other circuits. For instance, the circuit board 102 may include the control circuitry for a warmer element 108. The circuit board 102 is electrically coupled to a cable 104 using known techniques, wherein the cable 104 terminates in a connector 106. In this embodiment, the connector is a CPC connector; however, a variety of connectors may also be used. The cable 104 may include a plurality of cables which include cables for coupling electronic signals and cables for coupling power to the circuit board and to other elements of the toning assembly, such as the warmer element 108.

Figure 4:
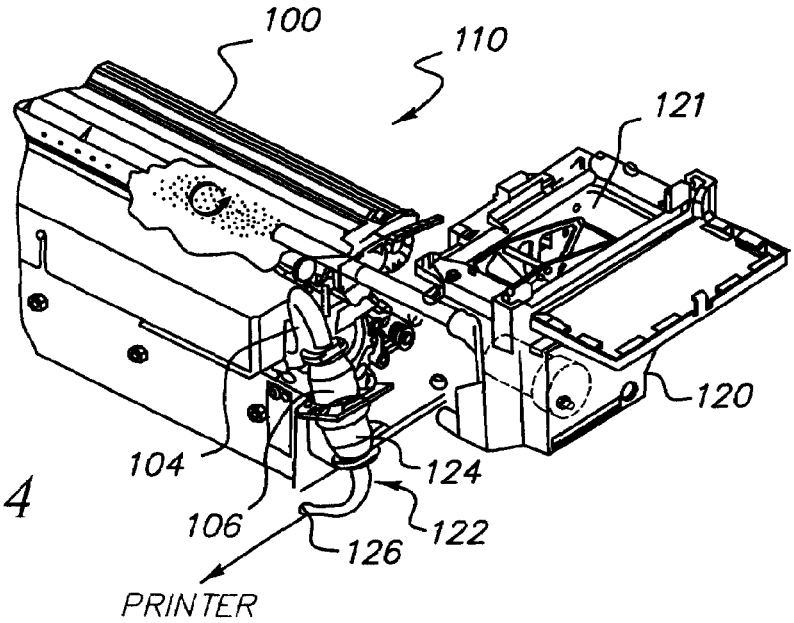
FIG. 4 is an isometric view of an embodiment of a coupling which couples a toner identification circuit to a print engine.

FIG. 4 shows the toning assembly 100 with a toner hopper 120, which, together with a toner bottle (not shown) inserted into hopper 121, comprise the toner station 110. The toner identification circuit is mounted on a circuit board (102 in FIG. 3) mounted to the toning assembly 100 of toner station 110 in the manner shown in FIG. 3, and coupled to cable 106. Cable 106 couples the toner identification circuit to the print engine of the printer (not shown) via cable 122. Cable 122 includes a connector 124 wherein the connector 124 is of a type that will mate with connector 106. The end of cable 122 opposite the connector 124 (126) is coupled to the print engine. To couple the toner identification circuit to the print engine, cable 104 is connected to cable 122 via connectors 106 and 124. The entire toner station 110, including the toner hopper and the toner bottle (not shown), are slid into a portion of the print engine physically constructed to receive the toner station 110.

Along with the identification algorithm, the toner identification module 52 may further include an algorithm for determining whether the installed toner holder is the correct toner holder for the job type chosen by the operator of the multi-toner printer (the "job selection algorithm"). The job selection algorithm may also include an algorithm mandating a security procedure ("security procedure algorithm") that, if not followed, results in the disallowance of the job selection. Embodiments of the job selection algorithm, including or without the security procedure algorithm, include computer readable software code. Such code may be stored on the processor 62, the memory device 60 or on a computer readable storage medium. Alternatively, the code may be encoded in a computer readable electrical or optical signal. The code may be object code or any other code describing or controlling the functionality described herein. The computer readable storage medium may be a magnetic storage disk such as a floppy disk, an optical disk such as a CD-ROM, semiconductor memory or any other physical object storing program code or associated data.

Figure 5:
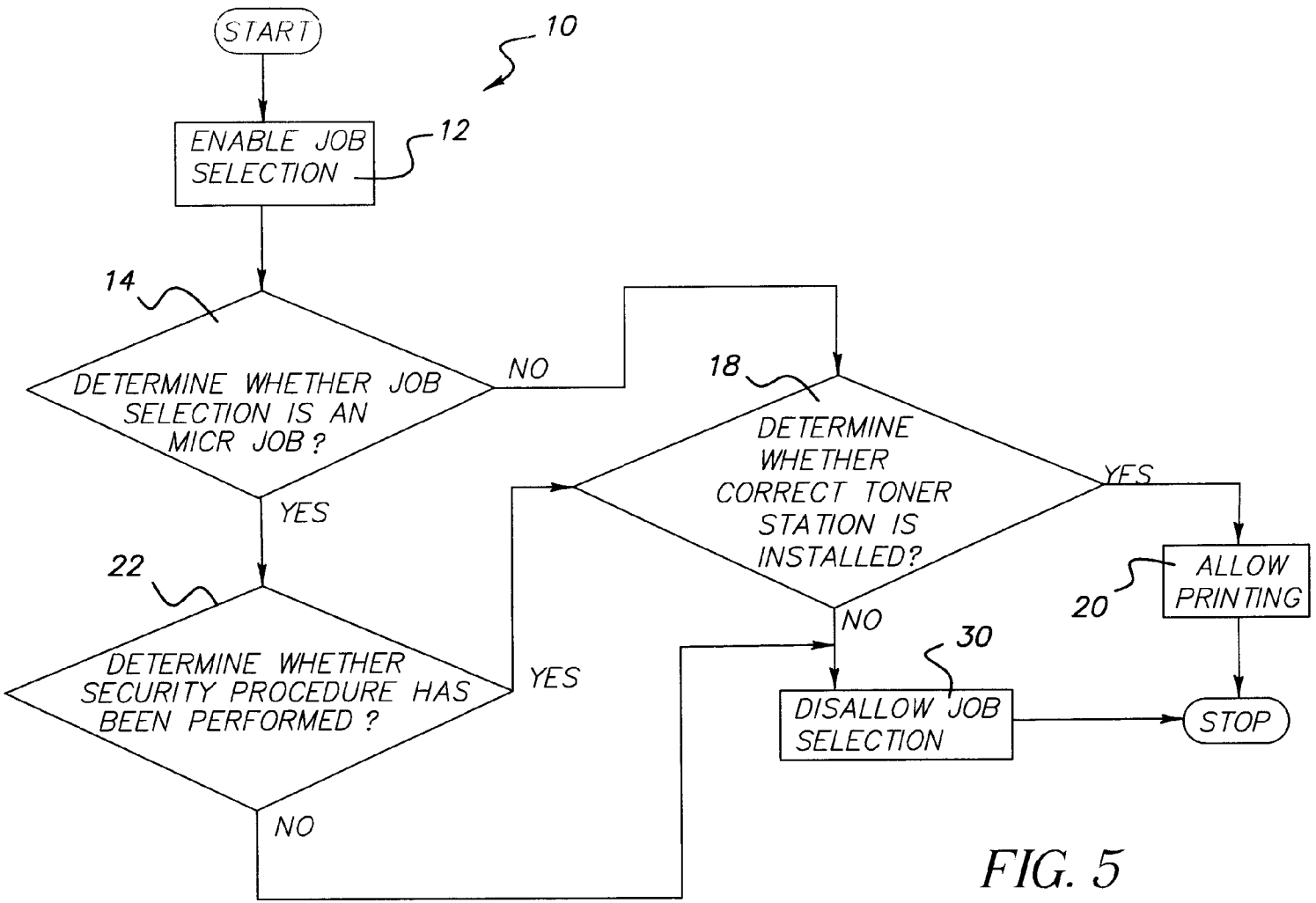
FIG. 5 is a flow chart of an embodiment of a job selection algorithm for a multi-toner printer.

A preferred job selection algorithm is shown in FIG. 5 and indicated by reference number 10. The job selection algorithm 10 generally includes the following steps, enabling job selection 12, determining whether the job selection is an MICR job 14, determining whether the security procedure has been performed 22, determining whether the correct toner holder is installed 18 and either allowing printing 20 or disallowing printing 30.

Initially, in the enable job selection step 12, the job selection algorithm 10 allows an operator of the multi-toner printer to enter a job selection or choose a preprogrammed job selection. For example, preprogrammed job selections may be stored in the memory device 60 shown in FIG. 1. When the operator begins the printing process, the processor 62 retrieves the preprogrammed job selections from the memory device 60 and sends them to the display device 54 where the preprogrammed job selections are communicated to the operator. The operator then selects one of the preprogrammed job selections, or defines a completely new job selection using the input device 74. Furthermore, if one of the preprogrammed job selections is selected, the operator may be able to modify any of attributes of the preprogrammed job selections. For example, the operator may like a preprogrammed job selection, but may desire more copies than the preprogrammed job selection has defined. In this case, the operator may choose the preprogrammed job selection and modify the specified number of copies.

In order to determine whether the job selection is an MICR job 14 or a non-MICR job (FIG. 5), it is determined whether the job selection defines attributes that are specific to an MICR job, such as, MICR toner for the type of toner, or an MICR-specific font for the font. Additionally, if it is determined that the job selection is an MICR job, a security procedure will be mandated and a determination will be made as to whether the mandated security procedure has been performed 22. This security procedure may involve entering a password, swiping a key card or obtaining approval from an authorized individual. This security procedure may be required for all print jobs or only for a select group or type of print jobs. In one example, the processor 62 shown in FIG. 1 determines whether the job selection defines attributes that are specific to an MICR job. Additionally, the security procedure may be stored in the memory device 60, required only for MICR jobs and implemented by the processor 62.

Referring to FIG. 5, if it has been determined that the mandated security procedure has been performed or that the job selected is not an MICR job, a determination will be made as to whether the toner holder installed in the multi-toner printer is the correct toner holder for the job selection 18. If it is, the job selection will be allowed to print 20, if it is not, the job selection will not be allowed to print 30. In one example, the toner holder is identified using the toner identification apparatus 50 shown in FIG. 1. Once the processor 62 determines the toner holder identity, the processor 62 compares the toner holder identity to the toner holder specified by the job selection. If the identity of the installed toner holder does not match the toner holder specified by the job selection, the job selection will be disallowed 30. Disallowing the job selection results in the inability to print unless the print selection is altered or a new, appropriate job selection is chosen.

In another example, all non-MICR jobs are assigned a default toner holder that includes other toners. Therefore, any non-MICR jobs not assigned a specific toner holder will be assigned the default toner holder. This means that if the job selection is a non-MICR job, and the installed toner holder includes MICR toner, the job selection will be disallowed, and the job selection will not be allowed to print. When implementing this example using the apparatus of FIG. 1, an individual assigns a default toner holder to specific job selections or job selection attributes by using the input device 55. The default toner holders and their associated job selections and/or job selection attributes are then stored in the memory device 60. When a job selection is made, the processor 62 will identify the toner holder installed in the multi-toner printer using the identification signal 72 created by the analog to digital converter 68 from the unique voltage identification signal 70 created by the toner identification circuit 66. The processor 62 will then compare the identity of the installed toner holder to the defined or default toner holder specified for the job selection entered by the operator. If the identity of the installed toner holder does not match the defined or default toner holder specified for the job selection, the processor will include a communication in the control signal 64 instructing a control device for the multi-toner printer (not shown) not to allow the job selection to print. Alternatively, if the identity of the installed toner holder does match the defined or default toner holder specified for the job selection, the processor will include a communication in the control signal 64 instructing control device to allow the job selection to print.

Although the methods and apparatuses disclosed herein have been described in terms of specific embodiments and applications, persons skilled in the art can, in light of this teaching, generate additional embodiments without exceeding the scope or departing from the spirit of the claimed invention.

What is claimed is:

1. A toner identification module, comprising:

a toner identification circuit, wherein the toner identification circuit produces a unique voltage identification signal for each of at least one toner holders;

an analog to digital converter coupled to the toner identification circuit and receiving the unique voltage identification signal, wherein the analog to digital converter converts the unique voltage identification signal into a corresponding digital identification signal;

an identification algorithm for creating at least one toner holder identity;

a memory device, wherein the identification algorithm is stored in the memory device; and a processor coupled to the memory device and the analog to digital converter and receiving the corresponding digital identification signal, wherein the processor performs the identification algorithm using the corresponding digital identification signal to create the at least one toner holder identity.

2. An toner identification apparatus, comprising:

at least one toner identification circuit, wherein each of the at least one toner identification circuits produces a unique voltage identification signal for one of at least one toner holders;

an analog to digital converter coupled to the at least one toner identification circuits and receiving the unique voltage identification signals, wherein the analog to digital converter converts each of the unique voltage identification signals into a corresponding digital identification signal;

an identification algorithm for creating a toner holder identity for each of the at least one toner holders;

a memory device, wherein the identification algorithm is stored in the memory device; and a processor coupled to the memory device and the analog to digital converter and receiving the corresponding digital identification signals, wherein the processor performs the identification algorithm using each of the corresponding digital identification signals to create a toner holder identity for each toner holder; and a display device coupled to the processor and receiving the at least one toner holder identity, wherein the display device displays the at least one toner holder identity.

3. An toner identification apparatus as claimed in claim 2, further comprising an input device coupled to the processor.

4. A toner identification circuit, comprising:

a power supply, wherein the power supply supplies a maximum voltage;

a voltage divider coupled to the power supply, wherein the voltage divider divides the maximum voltage supply into one of a plurality of initial identification voltages; and an amplifier coupled to the voltage divider and receiving the one of a plurality of initial identification voltages, wherein the amplifier produces an identification voltage.

5. A toner identification circuit, as claimed in claim 4, wherein the voltage divider comprises a DIP switch.

6. A multi-toner printer including a control unit, comprising:

at least one toner holder;

a control unit; and a toner identification module, comprising:

at least one toner identification circuit, wherein one of the at least one toner identification circuit is located on each of the at least one toner holders, wherein each of the at least one toner identification circuit produces a unique voltage identification signal for the at least one toner holder on which it is located;

an analog to digital converter coupled to the at least one toner identification circuit and receiving the unique voltage identification signal from each of the at least one toner identification circuit, wherein the analog to digital converter converts the unique voltage identification signals into at least one corresponding digital identification signal;

an identification algorithm for creating at least one toner holder identity for each of at least one toner holders;

a memory device, wherein the identification algorithm is stored in the memory device; and a processor coupled to the memory device and the analog to digital converter and receiving the at least one corresponding digital identification signals, wherein the processor performs the identification algorithm using the at least one corresponding digital identification signals to create a toner holder identity for each of the at least one toner holders.

7. A multi-toner printer, as claimed in claim 6, further comprising:

a user interface coupled to the processor, wherein the user interface enables input at least one job selection; and wherein the processor determines whether the toner holder is a correct toner holder for the at least one job selection, wherein if the toner holder is not the correct toner holder for the at least one job selection, disallows the at least one job selection by producing a control signal that directs the control unit not to print the at least one job selection and communicating the control signal to the control unit, and wherein if the toner holder is the correct toner holder for the at least one job selection, allows the at least one job selection to print by producing a control signal that directs the control unit to print the at least on job selection.

8. A job selection method for a multi-toner printer, comprising the steps of:

enabling input of at least one job selection;

identifying a toner holder installed in the multi-toner printer; and determining whether the toner holder is a correct toner holder for the at least one job selection, wherein if the toner holder is not the correct toner holder for the at least one job selection, disallowing the at least one job selection, and wherein if the toner holder is the correct toner holder for the at least one job selection, allowing the at least one job selection to print;

wherein said identifying further comprises:

producing a unique voltage identification signal for the toner holder; and converting the unique voltage identification signal into a corresponding digital identification signal.

9. A job selection method for a multi-toner printer, comprising the steps of:

enabling input of at least one job selection;

identifying a toner holder installed in the multi-toner printer; and determining whether the toner holder is a correct toner holder for the at least one job selection, wherein if the toner holder is not the correct toner holder for the at least one job selection, disallowing the at least one job selection, and wherein if the toner holder is the correct toner holder for the at least one job selection, allowing the at least one job selection to print;

wherein after the step of enabling input of at least one job selection, further comprising, determining whether the at least one job selection is an MICR job, wherein if the job is an MICR job, requiring performance of a security measure and determining if the security measure is performed, and wherein if the security measure is not performed, disallowing the selected job.

* * * * *